United States Patent [19]

DeMars

[11] Patent Number: 4,635,361

[45] Date of Patent: Jan. 13, 1987

[54] DISPOSABLE RAZOR

[76] Inventor: Robert DeMars, 7932 Maestro, Canoga Park, Calif. 91304

[21] Appl. No.: 742,473

[22] Filed: Jun. 7, 1985

[51] Int. Cl.[4] ..... B26B 21/44
[52] U.S. Cl. ..... 30/41; 30/86
[58] Field of Search ..... 30/41, 86; 222/95, 96

[56] References Cited

U.S. PATENT DOCUMENTS

| | | | |
|---|---|---|---|
| 1,899,841 | 2/1933 | Acken | 30/41 |
| 2,790,234 | 4/1957 | Goldstein | 30/41 |
| 4,129,942 | 12/1978 | Denizman | 30/41 |
| 4,476,630 | 10/1984 | Byrne | 30/47 |
| 4,562,643 | 1/1986 | Cataudella | 30/41 |

FOREIGN PATENT DOCUMENTS

| | | | |
|---|---|---|---|
| 533960 | 8/1954 | Canada | 222/95 |

*Primary Examiner*—E. R. Kazenske
*Assistant Examiner*—Michael D. Folkerts
*Attorney, Agent, or Firm*—Cislo, O'Reilly & Thomas

[57] ABSTRACT

A disposable shaving implement is provided, which is adapted to incorporate a tube of shaving lotion in its handle. A tube squeezing means is provided to dispense shaving lotion as desired. In one embodiment, the shaving lotion is dispensed from the bottom of the handle, using a dispensing closure that rotates in one position to permit dispensing and in another position to prevent dispensing. In another embodiment, the shaving lotion is dispensed from the top of the handle, behind the shaving head.

10 Claims, 6 Drawing Figures

10
12
14
16
18
20
22
24
26
28
30
32
34
36
38
40
42
44
46
48
50
52
2

DISPOSABLE RAZOR

BACKGROUND OF THE INVENTION

The present relates generally to shaving implements, and, in particular, to manually operated disposable razors.

In the conventional hand razor, a razor blade is mounted in the shaving head portion of the razor which is carried on the end of the handle normally grasped by the shaver during the shaving operation. In effecting the shaving operation, the user conventionally applies material, such as lather-forming material, to the face or body portion to be shaved.

Many attempts have been made to provide a handle which incorporates the lather-forming material in the handle. Examples of such patents include U.S. Pat. Nos. 3,985,146; 4,129,942; 2,019,957; 1,673,590; and 2,818,872. While many of these shaving implements are useful for their intended purpose, nonetheless, they often suffer from several drawbacks. For example, some combination razors provide only enough lather-forming material for one shave, while others require the handle to be flexible in order the squeeze the shaving material out; this latter configuration can result in some discomfort to the shaver if the handle flexes at an inappropriate time.

A need remains for a disposable razor which incorporates an adequate amount of shaving material in its handle.

OBJECTS AND SUMMARY OF THE INVENTION

It is an object of the invention to provide a disposable shaving implement having a handle adapted to receive a tube of shaving material and to dispense same.

It is another object of the invention to provide an shaving implement employing a rigid material for the handle.

It is still another object of the invention to provide a shaving implement having a dispensing means for dispensing shaving material as needed.

These and further objects of the invention will become apparent from the hereinafter following commentary taken in conjunction with the drawing.

In accordance with the invention, a disposable shaving implement having means defining a shaving head is provided. The shaving implement has a substantially rigid handle having a first portion carrying a shaving head suitably to permit the implement to be used as manually operated razor. The handle is provided with a longitudinal chamber adapted to receive a tube of shaving lotion. The tube of shaving lotion has a dispensing neck at one end. The handle is also provided with a channel, closed at both ends, formed on the same side of the handle as the shaving head and which communicates with the chamber. A slidable tube squeezing means is mounted in the channel and is adapted to squeeze lotion from the tube, moving in the direction away from the razor head. The handle is provided with a dispensing closure at one end; the dispensing closure comprises two portions, a first portion defining an interior chamber having two opposed openings, a first opening adapted to receive the open end of the tube and a second opening offset from the center of the handle. The second portion is rotatable and is provided with a passageway that is rotatable into position to align with the offset opening when shaving lotion is desired and rotatable out of position to disalign the passageway with the offset opening.

In an alternate embodiment, the handle, again provided with a longitudinal chamber, has an opening at its bottom for receiving the tube and an opening at its top behind the shaving head for receiving the dispensing neck of the tube. A channel is provided along the length of the handle, again on the same side as the shaving head, which communicates with the chamber. A removeable tube squeezing means, which is adapted to be slidably engaged in the channel for squeezing lotion out of tube, is provided. The tube squeezing means is advanced along the handle in the direction of the razor head.

DETAILED DESCRIPTION OF THE PREFERRED EMBODIMENTS

Figures 1, 2, 3:
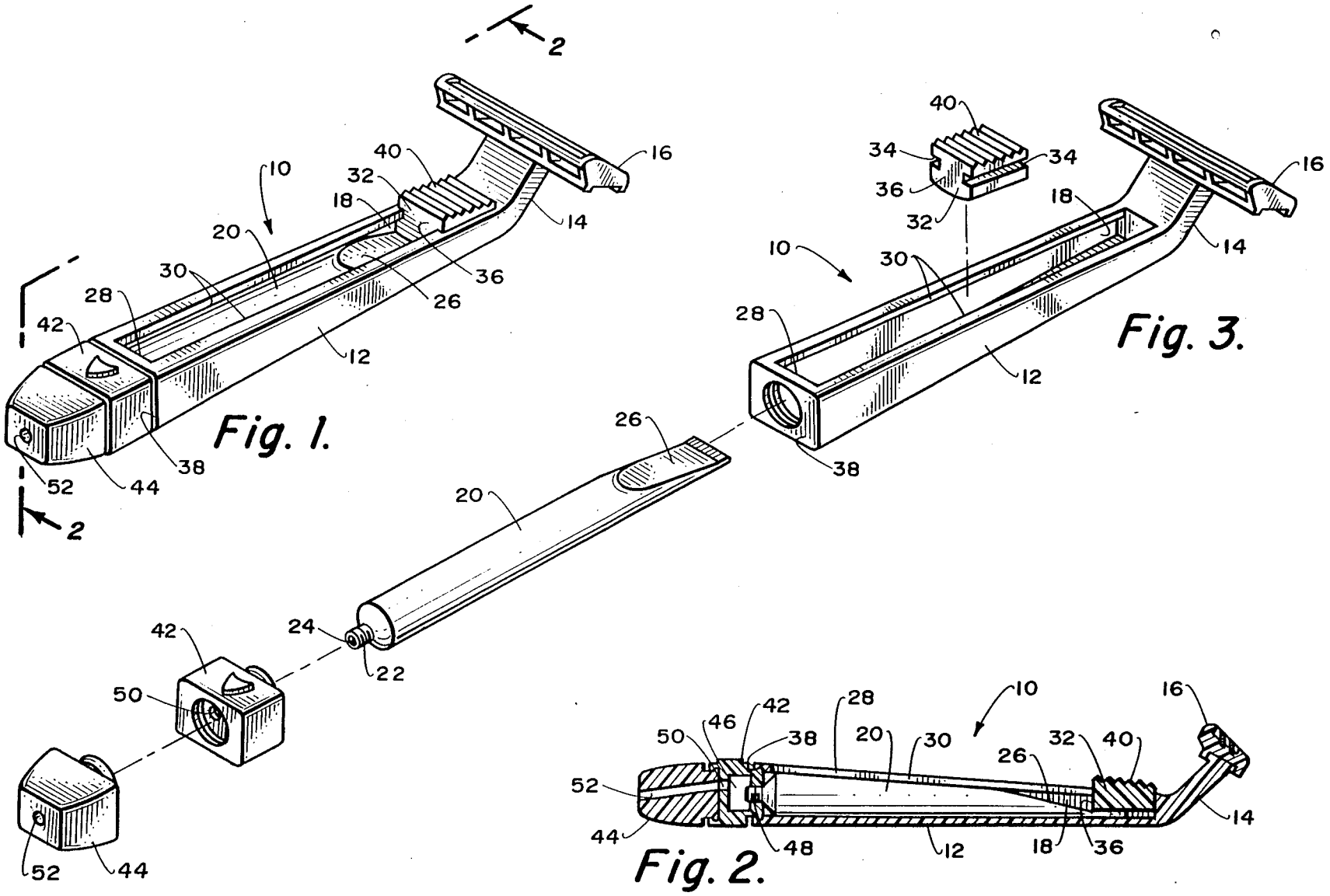
FIG. 1 is a perspective view of a disposable shaving implement in accordance with one embodiment of the invention.
FIG. 2 is a cross-sectional view taken along the line 2—2 of FIG. 1.
FIG. 3 is a perspective view, exploded, of the shaving implement of FIG. 1.

Referring now to the drawing wherein like numerals of reference represent like elements throughout, a first embodiment of a disposable shaving implement is depicted in FIGS. 1–3 generally at 10. The shaving implement comprises a substantially rigid handle 12 and a first portion 14 which carries a shaving head 16 thereon. The first portion 14 is angled to suitably permit the implement to be used as a manually operated razor. The shaving head 16 conveniently comprises a shaving head of the type employed in disposable razors, and thus forms no part of this invention.

The handle 12 is provided with a chamber 18 running the length of the handle 12, which is adapted to receive a tube 20 of a shaving lotion. The tube 20 of shaving lotion may comprise any of the shaving lotions or emollients commonly used in manual shaving, such as gels, foams and the like. Preferably, the tube 20 contains an adequate amount of shaving material, approximately the lifetime of the shaving head 16 of the disposable razor 10.

One end of the tube 20 of shaving lotion is provided with a dispensing neck 22 which in turn includes an opening 24, out of which the shaving lotion is dispensed. The tube 20 of shaving lotion may be provided at its opposite end with an indentation or depression 26 to permit ease of dispensing, as will be discussed in further detail below.

The handle also includes a channel 28, closed at both ends. The channel 28 is defined by sides 30. The channel 28 communicates with the chamber 18 and is formed on the same side of the handle 12 as the shaving head 16.

A tube squeezing means 32 is slidably mounted in the channel 28. Conveniently, the tube squeezing means 32 is provided with a pair of opposed slots 34, which slidably engage the sides 30 of the channel 28. The pair of opposed slots 34 define a downwardly depending portion 36, which is urged against the wall of the tube 20, thereby forcing shaving lotion out through the dispensing neck 22.

It will be appreciated that the tube squeezing means 32 makes its traverse starting from the end of the shaving handle near the shaving head 16 and moving downwardly toward the bottom end 38 of the handle 12, squeezing shaving lotion out of the tube 20 during its travel. For greater ease of the user, the tube squeezing means 32 may be provided with a series of ridges 40. Such ridges 40 frictionally engage a part of the user's anatomy, i.e., thumb or finger.

To control the amount of shaving lotion dispensed, a dispenser is provided, comprising two parts 42 and 44. Part 42, which conveniently snap fits onto the end 38 of the handle 12, comprises an interior chamber 46 which is completely enclosed except for two openings. The first opening 48 is intended to fit over the neck 22 of the tube 20 and provide a reasonably tight seal to prevent shaving lotion from backing up into the cavity 18. A second opening 50 is at the opposite side of the interior chamber 46 in the portion 42. The opening 50 is preferably offset from the vertical center axis of the handle.

Part 44, which conveniently snap fits into part 42, is rotatably engaged therein. In particular, part 44 is rotatable 90 degrees and is provided with an opening 52, which in one position aligns with the opening 50 in the part 44 and when part 44 is then rotated 90 degrees, the opening 52 is no longer aligned with the opening 50. Thus, rotation of part 44 into one position permits dispensing of the shaving lotion and in another position prevents dispensing of the shaving lotion.

In operation, the tube 20 is inserted in the chamber 18 of the handle 12. The tube squeezing means 32 is initially positioned near the end 14 by this operation or may be first placed there before inserting the tube 20. The part 42, with its attached rotatable part 44 is then snap-fit into the bottom 38 of the handle 12. Since such tubes 20 are ordinarily furnished with closure cap (such as 164, in FIGS. 4–6) the cap is removed at any convenient time prior to attaching part 42.

The tube squeezing means 32 is initially located over the indentation 26 of the tube 20. As shaving material is desired, the tube squeezing means 32 is simply advanced in channel 28 toward the end 38 of the handle 14, as depicted in FIG. 2, depressing the walls of the tube 20. Of course, part 44 must first be rotated into proper position, as discussed above, to permit dispensing the shaving material.

While it will be appreciated that a particular configuration for the tube squeezing means 32 and the two parts 42 and 44 for dispensing shaving lotion have been depicted herein, other configurations which accomplish the same purpose are also intended to be included within the scope of the invention.

Figures 4, 5, 6:
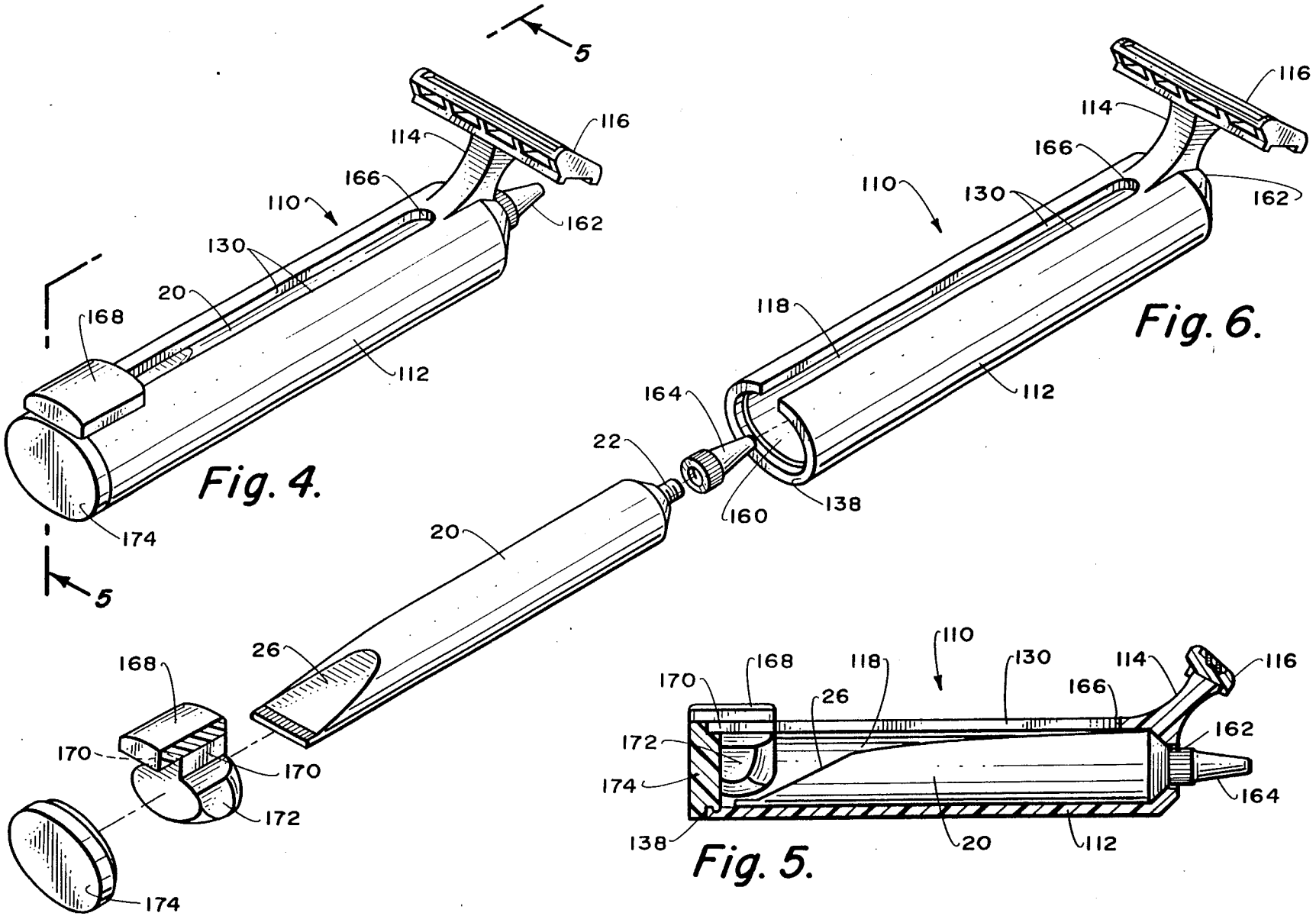
FIG. 4 is a perspective view of an alternate embodiment of the invention.
FIG. 5 is a cross-sectional view taken along the line 5—5 of FIG. 4.
FIG. 6 is a perspective view, exploded, of the shaving implement of FIG. 4.

An alternate embodiment is depicted in FIGS. 4–6. The disposable shaving implement, depicted generally at 110, comprises a handle 112 having a first portion 114 carrying a shaving head 116. As in the previous embodiment, the shaving head 116 is suitably angled to permit use as a manually operated razor. In this embodiment, the shaving handle 112 is approximately cylindrical, being in fact ellipsoidal in cross-section.

The handle 112 is provided with a chamber 118 having a large opening 160 at end 138 of the handle and a smaller opening 162 at the opposite end, near the first portion 114 and behind the shaving head 116. The large opening 160 is adapted to receive a tube 20 of shaving lotion, while the opening 162 is adapted to receive the neck 22 of the shaving tube 20, which is provided with a cap 164. The cap 164 is removable for dispensing shaving lotion from the tube 20.

The handle 112 is also provided with a channel 166 which runs the length of the handle, terminating at the end 138 thereof and communicating therewith. The channel 166 also communicates with the chamber 118 and is defined by sides 130.

A tube squeezing means 168 is adapted to slidably move in the channel 166. The tube squeezing means 168 is provided with a pair of slots 170 which slidably engage the sides 130 of the channel 166. Further, the tube squeezing means 168 is provided with a downwardly depending portion 172 conveniently of approximately bulbous shape for aiding in dispensing the shaving lotion.

Finally, a cap 174 is provided which prevents the tube 20 and tube squeezing means 168 from inadvertently falling out or otherwise being lost. Cap 174 conveniently snap-fits on the end 138 of the handle 112.

In operation, the tube 20 is inserted in the handle 112, the tube squeezing member 168 is aligned at the bottom end 26 of the tube, engaged in the slot 166, and the cap 174 is attached to the end 138 of the handle 112. The closure cap 164 is removed from the tube 20 at the time the shaving material is desired to be dispensed and the tube squeezing member 168 is moved upward along the handle 112 toward the shaving head 116 end of the handle, squeezing out sufficient shaving lotion as desired.

All parts of the shaving implement disclosed herein (with the exception of razor blade itself) are of substantially rigid material. Plastics such as those presently used with disposable razors are suitably employed in the practice of the invention.

Thus, there has been disclosed a disposable razor for shaving, which incorporates a means for dispensing shaving material from the handle. Various modifications and changes will make themselves available to those of ordinary skill in the art, and all such modifications and changes not deviating from the spirit and scope of the invention are intended to be covered by the appended claims.

What is claimed is:

1. A disposable shaving implement having means defining a shaving head, wherein the improvement comprises:

a handle having a first portion carrying said shaving head suitably to permit said implement to be used as a manually operated razor;

said handle further provided with a longitudinal chamber and adapted to receive a tube of shaving lotion having a dispensing neck, said handle being provided with a channel opening in one side face thereof which communicates with said chamber; said channel opening having longitudinal side edges;

a slidable tube squeezing means mounted in said channel opening and adapted to squeeze lotion from said tube, wherein said slidable tube squeezing means comprises:

(1) a top member having a surface adapted to cooperatively engage a thumb of a user in a pushing or retracting motion, (2) a downwardly depending bulbous portion located within said chamber and adapted to exert squeezing pressure against said tube of lotion, and (3) a pair of slot means in respective sides of said tube squeezing means parallel to each other and to the plane defined by said top member, between said top member and said downwardly depending bulbous portion and adapted to cooperatively engage said side edges of said channel opening in slidable fashion; and said handle further provided with a second portion at an end opposite said first portion having secured thereto dispensing closure means comprising two parts, a first part adapted to receive said dispensing neck of said tube and a second part rotatable with respect to said first part, said parts being provided with passageways that permit communication between said end of said tube and the end of said dispensing closure when said second part is rotated into one position and which prevent said communication when said second part is rotated into another position.

2. The implement of claim 1 wherein said second part is rotatable 90 degrees with respect to said first part.

3. The implement of claim 1 wherein said first part has an interior chamber having two opposed openings, a first opening adapted to receive said neck of said tube and a second opening offset from the center axis of said handle and wherein said second part has an interior passageway that is rotatable into position to align with said offset opening when lotion is desired and rotatable out of position to disalign said passageway with said offset opening.

4. The implement of claim 1 wherein said slidable squeezing means includes ridges on said thumb engaging surface of said top member.

5. The implement of claim 1 wherein said channel opening is formed on the same side of said handle as said shaving head.

6. A disposable shaving implement having a top provided with means defining a shaving head, wherein the improvement comprises:

a handle having a first portion carrying said shaving head suitably to permit said implement to be used as a manually operated razor and having a chamber adapted to receive a tube of shaving lotion having a dispensing neck, said handle provided with an opening at its bottom for receiving said tube, and an opening at said top, behind said shaving head, for receiving said dispensing neck and a channel opening extending along the length of said handle and communicating with said chamber, said channel opening having longitudinal side edges, and a removable tube squeezing means adapted to be slidably engaged in said channel opening for squeezing lotion out of said tube as said squeezing means is advanced along the handle in the direction of the shaving head, wherein said slidable squeezing means comprises a top member having a surface adapted to cooperatively engage a thumb of a user in a pushing or retracting motion, a downwardly depending bulbous portion adapted to exert squeezing pressure against said tube of lotion, and a pair of slot means, parallel to each other and to the plane defined by said top member, between said top member and said downwardly depending bulbous portion and adapted to cooperatively engage said sides of said channel in slidable fashion.

7. The implement of claim 6 wherein said downwardly depending portion is approximately bulbous.

8. The implement of claim 6 wherein said handle has an approximately ellipsoidal cross-section.

9. The implement of claim 6 wherein said channel opening is formed on the same side of said handle as said shaving head.

10. The implement of claim 6 further provided with a removable cap for retaining said tube of shaving lotion and said tube squeezing means.

* * * * *